United States Patent [19]

Nishimura

[11] Patent Number: 4,560,268

[45] Date of Patent: Dec. 24, 1985

[54] IMAGE FORMING APPARATUS WITH PRETRANSFER DISCHARGER

[75] Inventor: Fuminobu Nishimura, Yokohama, Japan

[73] Assignee: Tokyo Shibaura Denki Kabushiki Kaisha, Kawasaki, Japan

[21] Appl. No.: 530,362

[22] Filed: Sep. 8, 1983

[30] Foreign Application Priority Data

Sep. 10, 1982 [JP] Japan ..... 57-158298

[51] Int. Cl.[4] ..... G03G 15/00

[52] U.S. Cl. ..... 355/3 R; 355/3 TR; 355/3 CH; 355/3 SH

[58] Field of Search ..... 355/3 R, 3 SH, 3 TR, 355/3 CH, 15, 133, 30; 362/224

[56] References Cited

U.S. PATENT DOCUMENTS

| | | | |
|---|---|---|---|
| 3,615,813 | 10/1971 | Clarke et al. | 355/15 X |
| 3,784,300 | 1/1974 | Hudson et al. | 355/3 R |
| 4,095,881 | 6/1978 | Maddox | 355/30 |
| 4,285,032 | 8/1981 | Honda et al. | 362/224 |
| 4,363,550 | 12/1982 | Toshimitsu et al. | 355/3 TR |

*Primary Examiner*—A. T. Grimley
*Assistant Examiner*—J. Pendegrass
*Attorney, Agent, or Firm*—Cushman, Darby & Cushman

[57] ABSTRACT

In an image forming apparatus, a main charger, an exposure section, a developing device, a pair of restart rollers, a transfer device, a separator, a cleaning unit and a discharger surround an image carrier and are arranged successively along a rotating direction of the drum. One of the restart rollers on the image carrier side includes a discharge lamp.

6 Claims, 4 Drawing Figures

IMAGE FORMING APPARATUS WITH PRETRANSFER DISCHARGER

BACKGROUND OF THE INVENTION

The present invention relates to an image forming apparatus having a photosensitive drum, and more specifically to an image forming apparatus having a photosensitive drum with a relatively small diameter.

Recently small-sized information apparatuses have been developed which can be placed on a desk for personal use. To miniaturize the apparatuses, the packing density of circuits is increased and component accuracy improved. Miniaturization is also required of image forming apparatuses such as facsimiles and copying machines. Among the image forming apparatuses, those apparatuses which have an image carrier (hereinafter referred to as a photosensitive drum) rotating in the center of the apparatus housing must be designed so that the diameter of the photosensitive drum is reduced for compactness. Accordingly, process units, such as a charger, developing device, transfer device, cleaning unit, discharger, etc., arranged around the photosensitive drum, must also be reduced in size.

Thus, in the image forming apparatuses of this type, the process units surrounding the photosensitive drum are limited in size as the diameter of the photosensitive drum is reduced from 100 mm to 80 mm, for example. In this operation, it is expressly advisable to provide, e.g., pretransfer and precleaning dischargers. The use of the pretransfer discharger improves transfer efficiency and permits production of copy images of high quality. The precleaning discharger improves cleaning efficiency and ensures satisfactory cleaning of the photosensitive drum. However, the miniaturization of these units has limits. As the space around the photosensitive drum is reduced, therefore, these units are conventionally omitted from the arrangement of the image forming apparatuses. Thus, the quality of copy images produced is low.

SUMMARY OF THE INVENTION

The present invention is contrived in consideration of the aforementioned circumstances in mind, and is intended to provide an image forming apparatus using a photosensitive drum of small size without lowering the quality of the images produced.

According to one aspect of the present invention, there is provided an image forming apparatus which comprises a rotatable photosensitive drum, charging means, an exposure section, developing means, transfer means, separating means, cleaning means and discharge means arranged around the photosensitive drum, and paper supplying means for supplying transfer paper to a space between the transfer means and the photosensitive drum, the paper supplying means including a pair of paper feed rollers arranged beside the photosensitive drum, characterized in that one of the paper feed rollers on the photosensitive drum side includes a discharge lamp.

According to another aspect of the present invention, there is provided an image forming apparatus which comprises a rotatable photosensitive drum, charging means, an exposure section, developing means, transfer means, separating means, cleaning means and discharge means arranged around the photosensitive drum, characterized in that the cleaning means includes a toner recovery roller formed from a discharge lamp.

DETAILED DESCRIPTION OF THE PREFERRED EMBODIMENT

One embodiment of an image forming apparatus according to the present invention used in an electronic copying apparatus will now be described in detail with reference to the accompanying drawings.

Figure 1:
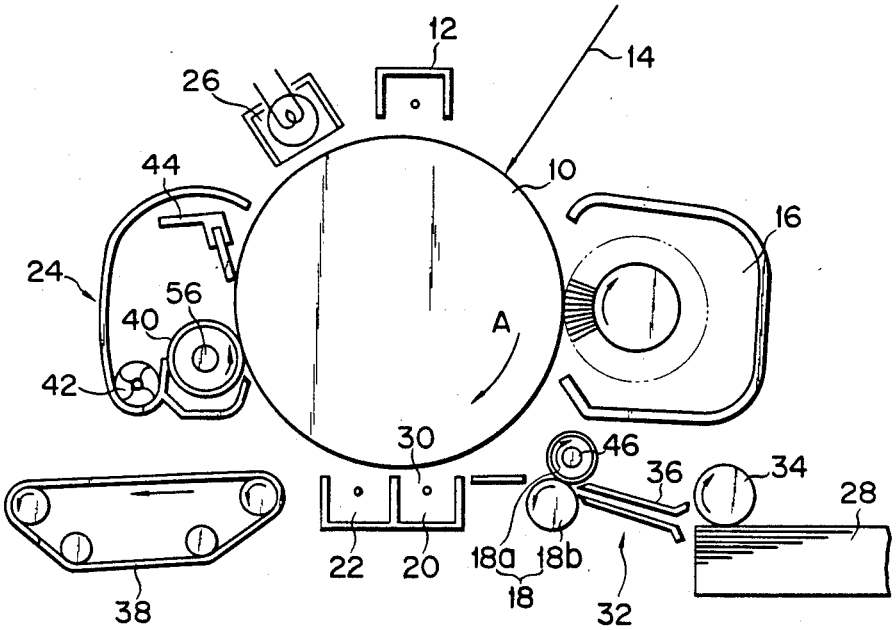
FIG. 1 is a side view schematically showing the internal structure of one embodiment of an electronic copying apparatus according to the present invention.

Referring first to FIG. 1, the internal structure of the electronic copying apparatus will be described in brief. A photosensitive drum 10 with a diameter of approximately 80 mm is disposed substantially in the center of a housing (not shown) of the apparatus so as to rotate in the clockwise direction indicated by arrow A. A main charger 12, an exposure section 14, a developing device 16, a pair of restart rollers 18 as paper feed rollers, a transfer device 20, a separator 22, a cleaning unit 24, and a discharger 26 surround the drum 10 and are arranged successively along the rotating direction of the drum 10. A paper cassette 28 is detachably attached to one end portion of the housing. Copying sheets P are stored in a pile in the paper cassette 28. A feed mechanism 32 in the housing picks up the sheets P one by one and delivers them to a transfer section 30 defined between the transfer device 20 and the drum 10. The feed mechanism 32 includes a paper supply roller 34 which rotates in contact with the uppermost one of the copying sheets P thereby picking up the sheets P one after another, the pair of restart rollers 18, and a pair of guide plates 36 which are interposed between the paper supply roller 34 and the restart rollers 18 to guide the copying sheets P that have been picked up to the restart rollers 18. Provided beside the separator 22 is a delivery mechanism 38 which delivers the copying sheets P separated from the drum 10 to a fixing unit (not shown).

In operation, the main charger 12 first uniformly charges the surface of the drum 10 rotating in the direction of arrow A. Then, a reflected light beam from an original is applied to the exposure section 14 so that electric charges remaining on the drum 10 form an electrostatic latent image thereon. The electrostatic latent image is supplied with a developing agent, such as toner, by the developing device to be developed into a visible image. The toner image on the drum 10 is transferred by the transfer device 20 to a copying sheet which is delivered from the paper cassette 28 by the paper supply roller 34 and whose forward edge is aligned with the visible image on the drum 10 by the restart rollers 18 consisting of a pair of rollers 18*a* and 18*b*. After the transfer, the copying sheet is separated from the drum 10 by the separator 22 and carried on the delivery mechanism 38. Then, the toner image is fixed to the transfer sheet by the fixing unit, and the copying sheet is issued as a copy from the image forming apparatus.

Not all the toner on the photosensitive drum 10 is transferred to the copying sheet by the transfer device 20, some is left on the drum 10 after the transfer. The remaining toner on the drum 10 is removed to a toner recovery screw 42 by a toner recovery roller 40, and still remaining portions are thoroughly removed from the surface of the drum 10 by a cleaning blade 44. Finally, the electrostatic latent image is removed from the drum 10 by the discharger 26, and the copying process is completed.

The arrangements of the restart rollers 18 and the toner recovery roller 40 constitute features of the present invention whereby the apparatus of the invention is distinguished from the prior art apparatus.

Figure 2:
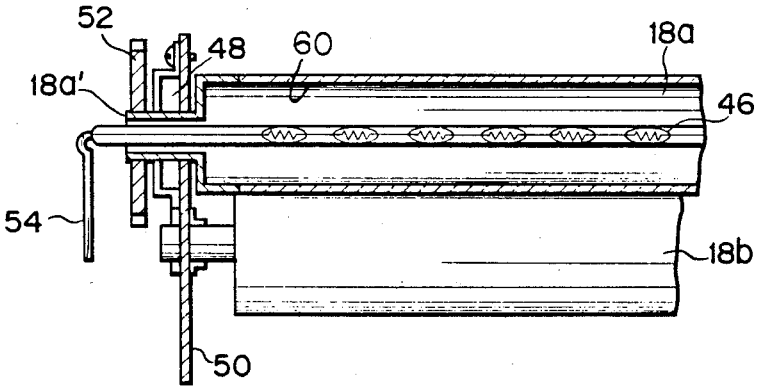
FIG. 2 is a front sectional view showing a restart roller extracted from the main apparatus.
Figure 3:
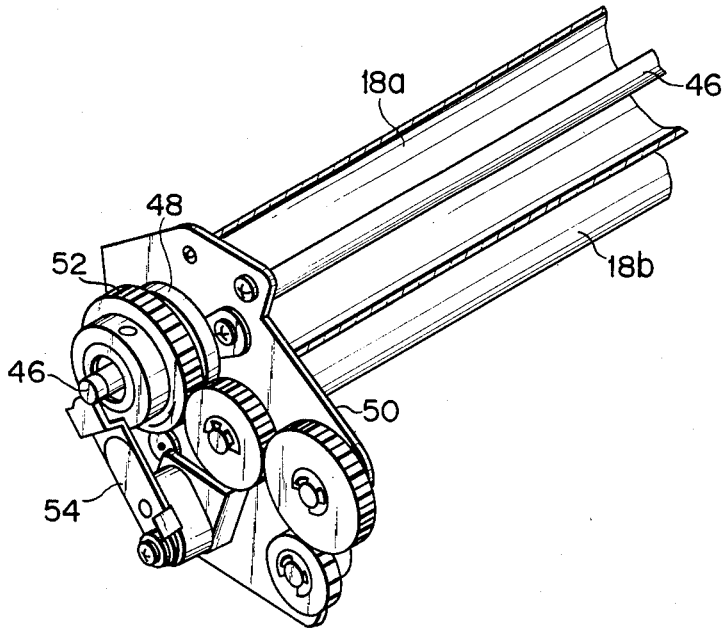
FIG. 3 is a broken away, perspective view showing the other restart roller extracted from the main apparatus.

A discharge lamp 46 is contained in the one restart roller 18*a* which is formed from a transparent material having light transmitting capability. Thus, the restart roller 18*a* is formed integrally with a pretransfer discharger. Accordingly, pretransfer discharge can effectively be achieved without a large space requirement by controlling the wavelength of a light beam transmitted through the restart roller 18*a*. Namely, the pretransfer discharger integral with the restart roller 18*a* attenuates the holding force of the electric charges defining the electrostatic latent image on the photosensitive drum 10, so that the toner image can be smoothly transferred to the transfer sheet P. Also, the temperature of the drum 10 can be prevented from rising by impregnating the surface of the restart roller 18*a* with an infrared absorbing filter component 60. As shown in FIGS. 2 and 3, the restart roller 18*a* is rotatably supported on a frame 50 of the housing by means of a bearing 48. A gear 52 is mounted on the free end portion 18*a'* of the restart roller 18*a*. The gear 52 is coupled to a drive source (not shown) for rotation. The discharge lamp 46 is supplied with electric power by means of a feeding blade 54.

The toner recovery roller 40 is formed integrally with a precleaning discharger. Namely, the toner recovery roller 40 is formed of a light transmitting cylindrical body containing a discharge lamp 56 therein. A transmitted light beam is applied to the surface of the photosensitive drum 10 to de-electrify the same. Since the toner recovery roller 40 and the precleaning discharger are formed integrally, de-electrification can be achieved without requiring extra space. The construction of other portions of the present invention are substantially the same as the prior art construction, and is not described in detail herein.

Figure 4:
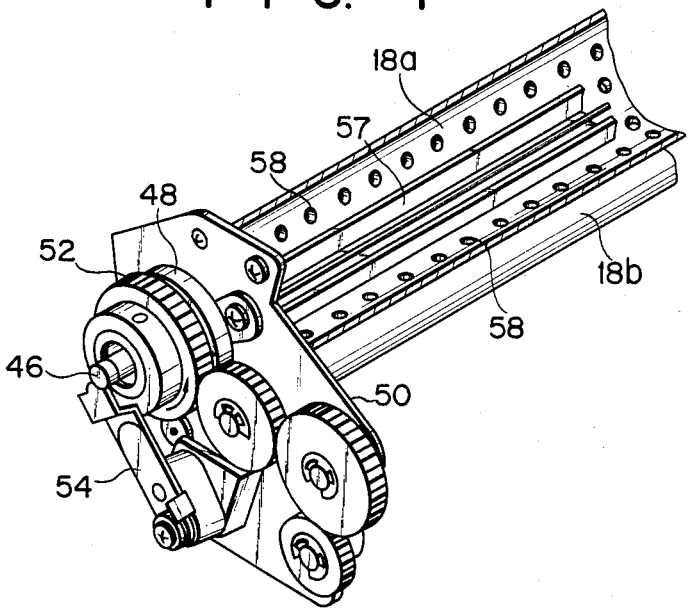
FIG. 4 is a broken away, perspective view showing a modification of the restart roller.

It is to be understood that the aforementioned embodiment has been described as a mere example, and that each member can be replaced with another member having the same function. As shown as a modification in FIG. 4, the restart roller 18*a* may contain a charger 57 in place of the discharge lamp 46 and has a number of holes 58 on the outer periphery thereof for de-electrification. Although the restart roller 18*a* and the toner recovery roller 40 each serve also as a discharger in the foregoing embodiment, it is to be understood that only one of these rollers 18*a* and 40 may be used as a discharger.

According to the present invention constructed in this manner, dischargers or other process units essential to image forming are contained in rollers or other rotating bodies which can conventionally be used for only a single purpose such as a restart roller or toner recovery roller. Also, the process units for the image forming operation can easily be arranged in a narrow space around a photosensitive drum of small size, ensuring production of stable copy images. Furthermore, the apparatus of the invention is very simple in construction, highly reliable, and is inexpensive to manufacture.

What is claimed is:

1. An image forming apparatus comprising:

a rotatable image carrier for carrying an image formed thereon;

developing means for developing the image formed on the image carrier with a developer to form a developer image;

transfer means for transferring the developer image from the image carrier to a transfer paper, said developing means and transfer means both being arranged around the image carrier and with a space therebetween; and paper supplying means for supplying the transfer paper to said space between the transfer means and the image carrier, said paper supplying means including a pair of paper feed rollers, arranged beside the image carrier and between the developing means and transfer means, for clamping and conveying the transfer paper, one of said paper feed rollers including discharge means therein for attenuating the holding force of the electric charges defining the electrostatic latent image on the image carrier.

2. An image forming apparatus according to claim 1, wherein said discharging means includes a discharge lamp.

3. An image forming apparatus according to claim 2, wherein said one paper feed roller includes a cylindrical body which has light transmitting capability and whose outer surface is engageable with the transfer paper, and wherein said discharging lamp includes a light source contained in the cylindrical body which light source radiates through the cylindrical body a light beam for de-electrifying the electric charges.

4. An image forming apparatus according to claim 3, further comprising a filter on a peripheral surface of said cylindrical body for intercepting those components of light beam from the lamp which correspond to wavelengths which would cause the image carrier to heat up.

5. An image forming apparatus according to claim 1, wherein said discharging means includes a corona charger.

6. An image forming apparatus according to claim 5, wherein said one paper feed roller includes a cylindrical body which contains the corona charger, and has an outer peripheral wall with a number of holes through which the corona from the corona charger passes to the image carrier.

* * * * *